US009062669B2

(12) United States Patent
Hong et al.

(10) Patent No.: US 9,062,669 B2
(45) Date of Patent: Jun. 23, 2015

(54) RECIPROCATING COMPRESSOR

(75) Inventors: Eonpyo Hong, Seoul (KR); Hyuk Lee, Seoul (KR); Sunghyun Ki, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 227 days.

(21) Appl. No.: 13/808,981

(22) PCT Filed: Jul. 7, 2011

(86) PCT No.: PCT/KR2011/004986

§ 371 (c)(1),
(2), (4) Date: Jan. 8, 2013

(87) PCT Pub. No.: WO2012/005531

PCT Pub. Date: Jan. 12, 2012

(65) Prior Publication Data

US 2013/0115113 A1 May 9, 2013

(30) Foreign Application Priority Data

Jul. 9, 2010 (KR) ..... 10-2010-0066544

(51) Int. Cl.
*F04B 35/04* (2006.01)
*F04B 39/12* (2006.01)

(52) U.S. Cl.
CPC ..... *F04B 35/045* (2013.01); *F04B 39/121* (2013.01); *F04B 39/122* (2013.01); *F04B 39/127* (2013.01)

(58) Field of Classification Search
CPC .... F04B 39/127; F04B 39/122; F04B 39/121; F04B 35/045
USPC ..... 417/416, 417, 418, 363
See application file for complete search history.

(56) References Cited

U.S. PATENT DOCUMENTS

| | | | | |
|---|---|---|---|---|
| 6,729,861 | B2 | 5/2004 | Oh et al. | 417/417 |
| 6,863,506 | B2 | 3/2005 | Park et al. | 417/360 |
| 7,775,775 | B2 | 8/2010 | Cho et al. | 417/244 |
| 2003/0086796 | A1 | 5/2003 | Park et al. | 417/360 |
| 2003/0099559 | A1 | 5/2003 | Oh et al. | 417/417 |
| 2007/0041855 | A1 * | 2/2007 | Hansen et al. | 417/417 |
| 2008/0240937 | A1 | 10/2008 | Cho et al. | 417/268 |

FOREIGN PATENT DOCUMENTS

| | | | | |
|---|---|---|---|---|
| CN | 101205888 A | | 6/2008 | |
| KR | 10-0374838 | | 3/2003 | |
| KR | 10-0442386 | | 7/2004 | |
| KR | 10-2006-0039729 A | | 5/2006 | |
| KR | 10-0608695 | * | 8/2006 | F04B 17/04 |
| KR | 10-0783414 | | 12/2007 | |

OTHER PUBLICATIONS

International Search Report issued in PCT Application No. PCT/KR2011/004986 dated Mar. 9, 2012.
Chinese Office Action dated Aug. 29, 2014, issued in Application No. 201180034008.4 (with Korean translation).

* cited by examiner

*Primary Examiner* — Bryan Lettman
(74) *Attorney, Agent, or Firm* — Ked & Associates, LLP

(57) ABSTRACT

A reciprocating compressor is provided, a size of which may be reduced by closely attaching and securing a reciprocating motor and a cylinder of a compression device to a sealed receptacle to reduce a gap between a main body of the compressor and the sealed receptacle. In addition, an assembling process for the compressor may be simplified by separating a mover of the reciprocating motor and a piston of the compression device from each other. In addition, vibration of the sealed receptacle may be minimized by properly adjusting a mass of components in the reciprocating motor and the compression device, and elasticity of a spring that supports the reciprocating motor and the compression device to offset a force applied to the sealed receptacle. In addition, efficiency of the reciprocating motor may be enhanced by increasing a relative velocity of the reciprocating motor in comparison with a relative velocity of the compression device.

19 Claims, 3 Drawing Sheets

RECIPROCATING COMPRESSOR

BACKGROUND

1. Field

The present invention relates to a reciprocating compressor and, more particularly, to a reciprocating compressor using vibration.

2. Background

In general, a reciprocating compressor is a compressor in which a piston linearly reciprocates within a cylinder to suck, compress, and discharge a refrigerant. The reciprocating compressor may be classified into a connection type reciprocating compressor and a vibration type reciprocating compressor according to a piston driving method.

In the connection type reciprocating compressor, a piston is connected to a rotational shaft of a rotary motor by a connecting rod and reciprocates within a cylinder to compress a refrigerant. Meanwhile, in the vibration type reciprocating compressor, a piston is connected to a mover of a reciprocating motor which reciprocates, so as to vibrate together and reciprocate to compress a refrigerant. The present invention relates to a vibration type reciprocating compressor, and hereinafter, the vibration type reciprocating compressor will be referred to as a reciprocating compressor.

In the reciprocating compressor, the piston and the cylinder relatively reciprocate in a magnetic flux direction of the reciprocating motor to repeatedly perform a sequential process of sucking, compressing, and discharging a refrigerant.

However, in the related art reciprocating compressor, a compressor main body comprised of a reciprocating motor and a compression unit is installed to vibrate in a horizontal direction in an internal of an airtight container and supported by a support spring as a coil spring. Namely, a predetermined space is required for the compressor main body to be supported by the support spring between the airtight container and the compressor main body, increasing a size of the compressor.

Also, in the related art reciprocating compressor, since the mover of the reciprocating motor and the piston of the compression unit are combined to be assembled, concentricity of the mover and the piston should be consistent, making an assembly process of the compressor complicated as much.

In addition, in the related art reciprocating compressor, since the support spring is connected to a stator of a reciprocating motor and a cylinder of a compression unit and fixed in the airtight container, vibration of the reciprocating motor and that of the compression unit are transmitted to the airtight container as is to increase compressor vibration.

Also, in the related art reciprocating compressor, a stator of the reciprocating motor is integrally coupled to the cylinder of the compression unit or connected by a resonance spring, and a mover of the reciprocating motor is integrally connected to the piston of the compression unit, and thus, a velocity of the reciprocating motor and a relative velocity of the compression unit are equal. As a result, there is a limitation in increasing a velocity of the reciprocating motor, degrading compressor efficiency.

Therefore, an object of the present invention is to provide a reciprocating compressor reduced in size by reducing a space between a compressor main body and an airtight container.

Another object of the present invention is to provide a reciprocating compressor in which a mover and a piston of a compression unit are easily assembled to thus simplify an assembly process of the compressor.

Another object of the present invention is to provide a reciprocating compressor in which compressor vibration is attenuated by offsetting vibration of a reciprocating motor and vibration of a compression unit.

Another object of the present invention is to provide a reciprocating compressor in which a velocity of a reciprocating motor is increased by differently controlling a relative velocity of a reciprocating motor and a relative velocity of a compression unit, thus enhancing compressor efficiency.

SUMMARY

According to an aspect of the present invention, there is provided a reciprocating compressor including: an airtight container; a reciprocating motor including a stator fixed within the airtight container and a mover reciprocating in an air gap of the stator; a piston separated from the mover, elastically supported in the airtight container and making a reciprocal motion (or reciprocates); and a cylinder coupled within the airtight container such that it is spaced apart from the reciprocating motor and allowing the piston to be inserted therein to form a compression space.

According to another aspect of the present invention, there is provided a reciprocating compressor including: an airtight container communicating with a suction pipe and a discharge pipe; a reciprocating motor including stators fixed to the airtight container and a mover making a reciprocal movement with respect to the stator; a cylinder fixedly coupled within the airtight container; a piston slidably inserted into the cylinder to compress a refrigerant sucked into an internal space of the airtight container; a first resonance spring elastically supporting the mover with respect to the airtight container to induce a resonant motion of the mover; and a second resonance spring elastically supporting the piston with respect to the airtight container to induce a resonant motion of the piston.

In the case of the reciprocating compressor according to embodiments of the present invention, since the stators of the reciprocating motor and the cylinder of the compression unit are tightly attached and fixed to the airtight container, a space between the compressor main body and the airtight container is reduced to reduce a size of the compressor. In addition, since the cylinder of the compression unit is tightly attached to the airtight container, a pipe such as a loop pipe is not required, reducing fabrication cost.

Also, since the mover of the reciprocating motor and the piston of the compression unit are separated, there is no need to make concentricity of the mover and the piston consistent, simplifying an assembly process of the compressor. Besides, since vibration of the reciprocating motor is transmitted to the compression unit through the airtight container, vibration of the airtight container can be attenuated.

Also, force applied to the airtight container can be offset by appropriately adjusting a mass of the stator of the reciprocating motor, and stiffness of the supporting spring, and a mass of the mover of the reciprocating motor, a mass of the piston of the compression unit, and stiffness of the resonance spring, whereby vibration of the airtight container can be minimized.

Also, a relative velocity of the reciprocating motor can be adjusted to be faster than that of the compression unit, thereby increasing motor efficiency.

DETAILED DESCRIPTION

Hereinafter, a reciprocating compressor will be described in detail with reference to a reciprocating compressor illustrated in the accompanying drawings.

Figure 1:
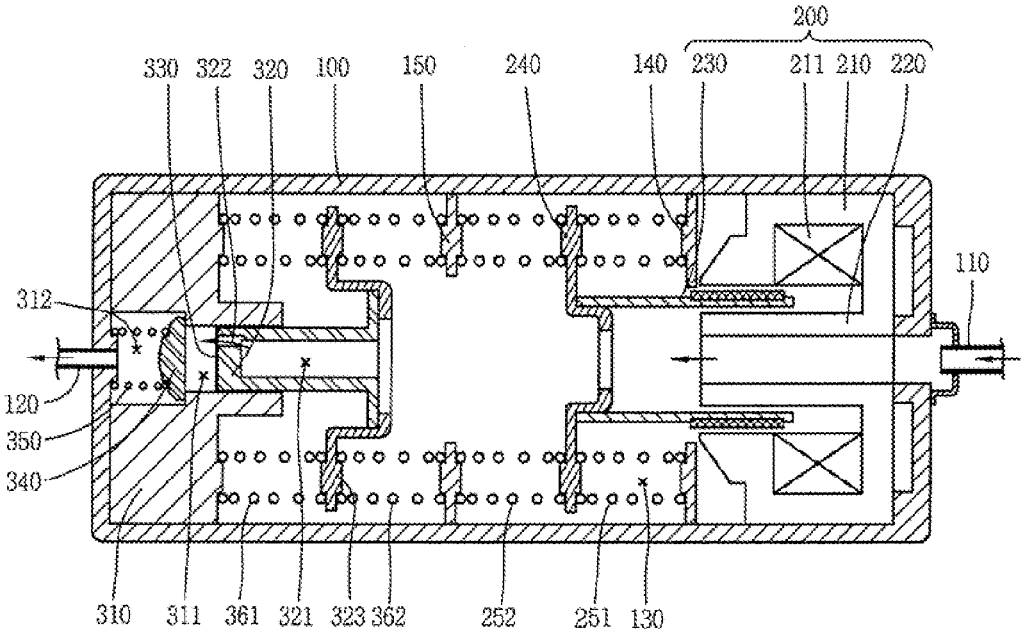
FIG. 1 is a vertical sectional view illustrating an example of a reciprocating compressor according to an embodiment of the present invention.
Figure 2:
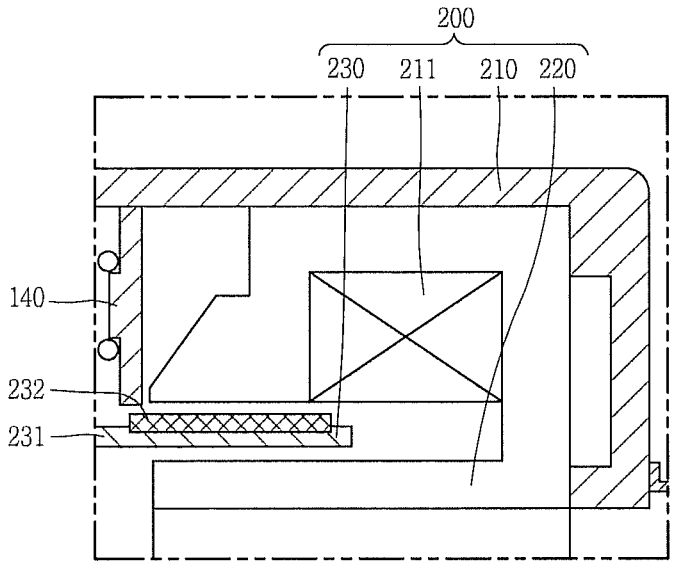
FIG. 2 is a vertical sectional view illustrating a portion of the reciprocating motor in the reciprocating compressor of FIG. 1.
Figure 3:
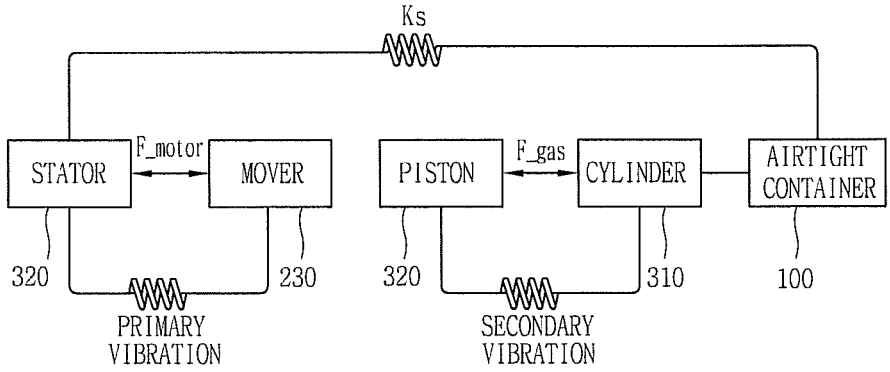
FIG. 3 is a schematic view illustrating a structure of the reciprocating compressor of FIG. 1.

FIG. 1 is a vertical sectional view illustrating an example of a reciprocating compressor according to an embodiment of the present invention. FIG. 2 is a vertical sectional view illustrating a portion of the reciprocating motor in the reciprocating compressor of FIG. 1. FIG. 3 is a schematic view illustrating a structure of the reciprocating compressor of FIG. 1;

Referring to FIG. 1, in the reciprocating compressor according to an embodiment of the present invention, a gas suction pipe 110 and a gas discharge pipe 120 are formed to be connected to both ends of an airtight container 100, a reciprocating motor 200, which linearly reciprocates, is installed within the airtight container 100, and a compression unit 300, in which a piston 320 separated from a mover 230 of the reciprocating motor 200 independently reciprocates with respect to the mover 230 to compress a refrigerant, is installed to be spaced apart from the reciprocating motor 200 within the airtight container 100.

The airtight container 100 is elastically supported by an installation surface on which the airtight container 100 is mounted, such that it may be able to vibrate in a motion direction of the mover 230, and the gas suction pipe 110 and the gas discharge pipe 120 are connected to both sides of the airtight container such that the gas suction pipe 110 and the gas discharge pipe 120 communicate therewith. An end of the gas suction pipe 110 is connected to communicate with an internal space 130 of the airtight container 100, and an end of the gas discharge pipe 120 is directly connected to a discharge cover 360 (to be described).

A first spring supporter 140 and a second spring supporter 150 are integrally formed to be spaced apart by a certain interval on both sides of an inner circumferential surface of the airtight container 100 in order to support ends of resonance springs 251, 252, 361 and 362 elastically supporting the mover 230 (to be described) and the piston 320.

The reciprocating motor 200 includes an outer stator 210 having a coil 211 and fixed to the airtight container 100, an inner stator 220 installed at an inner side of the outer stator 210 with an air gap having a certain space present therebetween and fixed to the airtight container 100 together with the outer stator 210, and a mover 230 linearly reciprocating between the outer stator 210 and the inner stator 220.

The outer stator 210 and the inner stator 220 may have an air gap formed in both sides based on the coil 211. In this case, however, magnetic flux generated by the coil 211 and the magnet 232 may be leaked to the outside of the stators and the magnet 232 is lengthened to increase fabrication cost. Thus, the outer stator 210 and the inner stator 220 may be formed to have a so-called 1-pole 2-gap configuration in which one sides thereof are connected based on the coil 211 and the other sides thereof have an air gap.

For example, the stator includes the outer stator 210 having the coil 211 and having a cylindrical shape and the inner stator 220 disposed at an inner side of the outer such that one side thereof is connected with the outer stator 210 and the other side thereof is disposed with a certain air gap, based on the coil 211, as shown in FIG. 2.

Since the annular coil is required to be installed at an inner side of the stator, the outer stator 210 and the inner stator 220 may have a channel-like shape and a straight line shape, separately, rather than being integrally formed, and assembled through welding, or the like.

The mover 230 includes a cylindrical magnet holder 231, and a plurality of magnets 232 are fixedly coupled to an outer circumferential surface of the magnet holder 231. A mover side supporter 240 is coupled to one end of the magnet holder 231, and a first motor side resonance spring 251 and a second motor side resonance spring 252 are installed in both sides of the mover side supporter 240. The other ends of the first motor side resonance spring 251 and the second motor side resonance spring 252 are fixed to one sides of the first spring supporter 140 and the second spring supporter 150 of the airtight container 100.

The motor side resonance springs 251 and 252 may be configured as a single compression coil spring or may be configured as a plurality of compression coil springs in a circumferential direction according to circumstances.

The compression unit 300 includes a cylinder 310 fixedly coupled to an inner circumferential surface of the airtight container 100, a piston 320 coupled to the mover 230 of the reciprocating motor 200 and reciprocating in a compression space 311 of the cylinder 310, a suction valve 330 installed in a front end of the piston 320 to open and close a suction flow channel 321 of the piston 320 and opening and closing a suction side of the compression space 311, a discharge valve 340 detachably installed in the cylinder 310 to open and close a discharge side of the compression space 311, and a valve spring 350 elastically supporting the discharge valve 340.

The cylinder 310 is fixed such that an outer circumferential surface thereof is tightly attached to an inner surface of the airtight container 100. The compression space 311 having an annular shape is formed in a central portion of the cylinder 310, and a discharge space 312 accommodating the discharge valve 340 and the valve spring 350 therein is formed in a row at an outer side of the compression space 311. The as discharge pipe 120 is directly connected to the discharge space 312 in a communicating manner and hermetically sealed.

The piston 320 is formed to have a cylindrical shape to form the suction flow channel 321 therein. A plurality of suction through holes 322 may be formed on an outlet of the suction flow channel 321 such that they communicate with the suction flow channel 321. A piston stopper 323 is coupled to one end of the piston 320, and a first compression unit side resonance spring 361 and a second compression unit side resonance spring 362 are installed in both sides of the piston stopper 323, respectively. The other ends of the first compression unit side resonance spring 361 and the second compression unit side resonance spring 362 are fixedly coupled to the other ends of the cylinder 310 and the second spring stopper 150.

The compression unit side resonance springs 361 and 362 may be configured as a single compression coil spring or may be configured as a plurality of compression coil springs in a circumferential direction according to circumstances.

The reciprocating compressor according to an embodiment of the present invention operates as follows.

Namely, as illustrated in FIG. 3, when power is applied to the coil 211 of the reciprocating motor 200, magnetic flux is formed between the outer stator 210 and the inner stator 220. Then, the mover 230 placed in the air gap between the outer stator 210 and the inner stator 220 moves in the direction of the magnetic flux and continuously reciprocates by the resonance springs 251 and 252.

Then, primary vibration is generated according to the reciprocating motion of the mover 230, and the primary vibration is transmitted to the airtight container 100.

Then, upon receiving the primary vibration through the airtight container 100, the piston 320 generates secondary vibration in a state of being elastically supported by the compression unit side resonance springs 361 and 362 and reciprocates. The piston 320 continuously reciprocates to compress a refrigerant to discharge the compressed refrigerant to a refrigerating cycle system. This sequential operation is repeatedly performed.

Here, force applied to the airtight container may be offset by appropriately adjusting a mass of the stator of the reciprocating motor and stiffness of the motor side resonance springs, and a mass of the mover of the reciprocating motor, a mass of the piston of the compression unit, and stiffness of the compression unit side resonance springs, whereby vibration of the airtight container can be minimized. In addition, since reciprocating motor and the compression unit serves as a mutual dynamic damper by the medium of the airtight container, vibration of the reciprocating motor can be attenuated.

Figure 4:
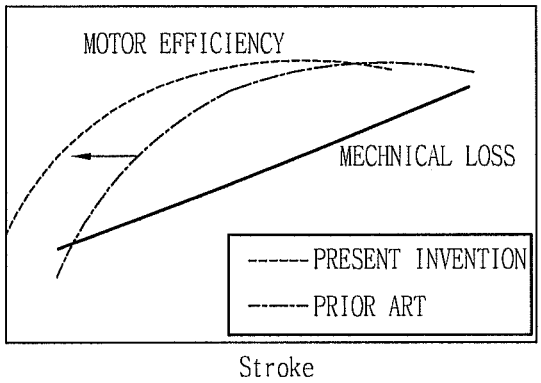
FIG. 4 is a graph showing a mechanical loss and motor efficiency of the reciprocating motor of FIG. 1.
Figure 5:
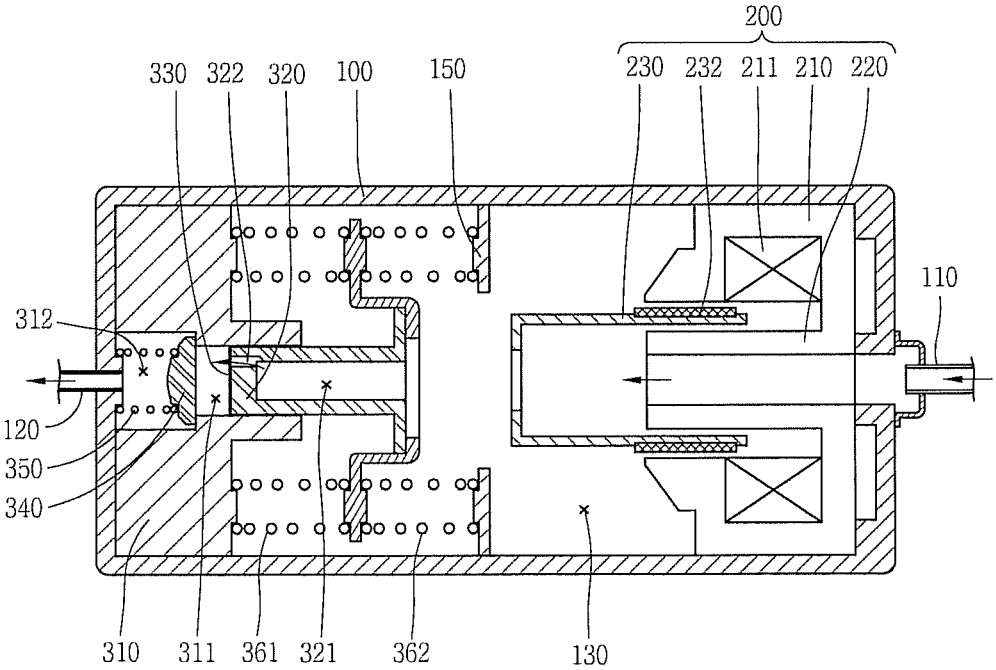
FIG. 5 is a vertical sectional view illustrating an example of a reciprocating compressor according to another embodiment of the present invention.

Also, since the stators of the reciprocating motor has a displacement, a relative displacement of the mover and the stators of the reciprocating motor and a relative displacement of the piston and the cylinder of the compression unit differ. By using such characteristics, a relative velocity of the reciprocating motor may be adjusted to be higher than a relative velocity of the compression unit, and such characteristics increase motor efficiency at a low velocity as shown in FIG. 4, and thus, motor efficiency can be increased, while reducing an input loss of the motor, on the whole.

Also, by tightly attaching and fixing the stators of the reciprocating motor and the cylinder of the compression unit to the airtight container, a space between the compressor main body and the airtight container may be reduced to reduce the size of the compressor. In addition, since the cylinder of the compression unit is tightly attached to the airtight container, there is no need to install a pipe such as a loop pipe having elasticity for sending a compressed refrigerant to the cycle, and thus, fabrication cost can be reduced.

Meanwhile, a reciprocating motor according to another embodiment of the present invention will be described.

Namely, in the foregoing embodiment, the mover of the reciprocating motor is supported by the resonance spring, but in the present embodiment, the mover 230 is installed to be able to reciprocate in an air gap between the outer stator 210 and the inner stator 220 such that the mover 230 can reciprocate in a free state.

In this case, a basic configuration and operational effect of the reciprocating compressor according to the present embodiment are similar to those of the foregoing embodiment, so a detailed description thereof will be omitted. However, in the present embodiment, the mover 230 is placed in the air gap in a free state and reciprocates according to magnetic flux. Thus, in order for the mover 230 to smoothly reciprocate, preferably, the stator of the reciprocating motor 200 is formed to have a so-called '1-pole 2-gap' configuration as in the foregoing embodiment.

In addition, in the present embodiment, motor side resonance springs for elastically supporting the mover 230 and a spring supporter, a spring supporter for supporting the motor side resonance springs, and a mover side supporter are not required, and thus, fabrication cost can be reduced relative to the foregoing embodiment.

Also, although not shown, the stator of the reciprocating motor may be formed to have a 2-pole 2-gap configuration in which air gaps are formed in both sides of the motor.

The invention claimed is:

1. A reciprocating compressor, comprising:

an airtight container having at least one spring supporter on an inner circumferential surface thereof;

a stator fixedly adhered to the inner circumferential surface of the airtight container and having an air gap;

a mover that reciprocates in the air gap of the stator;

a cylinder fixedly adhered to the inner circumferential surface of the airtight container;

a piston separated from the mover so as to independently reciprocate with respect to the mover, elastically supported in the airtight container, and that makes a reciprocal motion in the cylinder by vibration transmitted through the airtight container;

at least one motor side resonance spring provided for support between the at least one spring supporter and the mover; and at least one compression device side resonance spring provided for support between the at least one spring supporter and the piston.

2. The reciprocating compressor of claim 1, wherein the at least one spring supporter includes a first spring supporter and a second spring supporter disposed to be spaced apart by a predetermined interval, wherein the at least one compression device side resonance spring comprises a first compression device side resonance spring and a second compression device side resonance spring, wherein the at least one motor side resonance spring comprises a first motor side resonance spring and a second motor side resonance spring, wherein the mover is disposed between the first spring supporter and the second spring supporter, wherein the piston is disposed between the second spring supporter and the cylinder, wherein a first end of the first motor side resonance spring and a first end of the second motor side resonance spring are supported by surfaces of a mover side supporter coupled to the mover, and a second end of the first motor side resonance spring is supported by a first surface of the first spring supporter and a second end of the second motor side resonance spring is supported by a second surface of the first spring supporter, and wherein a first end of the first compression device side resonance spring and a second end of the second compression device side resonance spring are supported by surfaces of a piston side supporter coupled to the piston, and a second end of the first compression device side resonance spring is supported by a first surface of the second spring supporter and a second end of the second compression device side resonance spring is supported by a second surface of the second spring supporter.

3. The reciprocating compressor of claim 1, wherein the stator includes an outer stator and an inner stator, wherein a first side of the inner stator and a first side of the outer stator are connected and second sides thereof are separated to form an air gap allowing the mover to reciprocate therein.

4. The reciprocating compressor of claim 1, wherein a suction pipe communicates with an internal space of the airtight container, wherein the piston includes a suction flow channel formed in a penetrative manner to allow the internal space of the airtight container and a compression space of the cylinder to communicate with each other, wherein a suction valve configured to open and close the suction flow channel is installed at the end of the piston, and wherein a discharge valve configured to open and close the compression space of the cylinder is installed at an outlet of the compression space.

5. The reciprocating compressor of claim 4, wherein a discharge space is formed to communicate with the compression space in the cylinder, and wherein a discharge pipe is connected to the airtight container such that the discharge pipe communicates with the discharge space.

6. The reciprocating compressor of claim 1, wherein the airtight container is supported to be able to vibrate on an installation surface such that the airtight container reciprocates in a direction the mover of the reciprocating motor reciprocates.

7. A reciprocating compressor, comprising:

an airtight container having at least one spring supporter on an inner circumferential surface of the airtight container;

a reciprocating motor including stators fixedly adhered to the inner circumferential surface of the airtight container and a mover that makes a reciprocal movement with respect to the stators;

a cylinder fixedly adhered to the inner circumferential surface of the airtight container;

a piston separated from the mover so as to independently reciprocate with respect to the mover, elastically supported in the airtight container, and that makes a reciprocal motion in the cylinder by vibration transmitted through the airtight container; and at least one compression device side resonance spring provided for support between the at least one spring supporter and the piston.

8. The reciprocating compressor of claim 7, wherein the at least one compression device side resonance spring comprises a first compression side resonance spring supported between a first side of the cylinder and a first side of the piston, and a second compression side resonance spring supported between a second side of the piston and a second side of the at least one spring supporter.

9. The reciprocating compressor of claim 7, further comprising at least one motor side resonance spring provided for support between the at least one spring supporter and the mover, wherein the at least one motor side resonance spring comprises:

a first motor side resonance spring supported between a first surface of a mover side supporter coupled to the mover and a first surface of the at least one spring supporter; and a second motor side resonance spring supported between a second surface of the mover side supporter and a second surface of the at least one spring supporter.

10. A reciprocating compressor, comprising:

an airtight container;

a stator fixed within the airtight container and having an air gap;

a mover that reciprocates in the air gap of the stator;

a cylinder fixed within the airtight container; and a piston separated from the mover so as to independently reciprocate with respect to the mover, wherein a relative velocity of the mover with respect to the stator is adjusted to be higher than a relative velocity of the piston with respect to the cylinder.

11. The reciprocating compressor of claim 10, wherein the stator and the cylinder are fixedly adhered to an inner circumferential surface of the airtight container, respectively.

12. The reciprocating compressor of claim 11, wherein the piston is elastically supported in the airtight container, and makes a reciprocal motion in the cylinder by vibration transmitted through the airtight container.

13. The reciprocating compressor of claim 12, wherein at least one spring supporter is integrally formed on the inner circumferential surface of the airtight container, and wherein at least one compression device side resonance spring is supported between the at least one spring supporter and the piston, to induce a resonant motion of the piston.

14. The reciprocating compressor of claim 13, wherein the at least one compression device side resonance spring comprises a first compression device side resonance spring and a second compression device side resonance spring, and wherein a first end of the first compression device side resonance spring and a first end of the second compression device side resonance spring are supported by surfaces of a piston side supporter coupled to the piston, a second end of the first compression device side resonance spring is supported by a first surface of the at least one spring supporter and a second end of the second compression device side resonance spring is supported by a second surface of the at least one spring supporter.

15. The reciprocating compressor of claim 13, further comprising at least one motor side resonance spring provided for support between the at least one spring supporter and the mover.

16. The reciprocating compressor of claim 15, wherein the at least one motor side resonance spring comprises a first motor side resonance spring and a second motor side resonance spring, and wherein a first end of the first motor side resonance spring and a first end of the second motor side resonance spring are supported by surfaces of a mover side supporter coupled to the mover, a second end of the first motor side resonance spring is supported by a first surface of the at least one spring supporter and a second end of the second motor side resonance spring is supported by a second surface of the at least one spring supporter.

17. The reciprocating compressor of claim 10, wherein the stator comprises an outer stator and an inner stator, wherein a first side of the inner stator and a first side of the outer stator are connected and second sides thereof are separated to form an air gap to allow the mover to reciprocate therein.

18. The reciprocating compressor of claim 10, wherein a suction pipe communicates with an internal space of the airtight container, wherein the piston includes a suction flow channel formed in a penetrative manner to allow the internal space of the airtight container and a compression space of the cylinder to communicate with each other, wherein a suction valve configured to open and close the suction flow channel is installed at the end of the piston, and wherein a discharge valve configured to open and close the compression space of the cylinder is installed at an outlet of the compression space.

19. The reciprocating compressor of claim 18, wherein a discharge space is formed to communicate with the compression space in the cylinder, and wherein a discharge pipe is connected to the airtight container such that the discharge pipe communicates with the discharge space.

* * * * *